US007814842B2

(12) United States Patent
Early

(10) Patent No.: US 7,814,842 B2
(45) Date of Patent: Oct. 19, 2010

(54) HOPPER CAR GATE WITH A LATERALLY OPENING DOOR

(75) Inventor: Stephen R. Early, Olathe, KS (US)

(73) Assignee: Aero Transportation Products, Inc., Independence, MO (US)

( * ) Notice: Subject to any disclaimer, the term of this patent is extended or adjusted under 35 U.S.C. 154(b) by 0 days.

(21) Appl. No.: 12/265,117

(22) Filed: Nov. 5, 2008

(65) Prior Publication Data

US 2010/0107924 A1 May 6, 2010

(51) Int. Cl.
*B61D 3/00* (2006.01)

(52) U.S. Cl. ..... 105/282.3; 105/253; 105/247; 105/280

(58) Field of Classification Search ..... 105/253, 105/247, 280, 282.1–282.3, 289, 290
See application file for complete search history.

(56) References Cited

U.S. PATENT DOCUMENTS

| | | | | | |
|---|---|---|---|---|---|
| 272,550 | A * | 2/1883 | Hoit | 105/248 |
| 820,240 | A * | 5/1906 | Mulock | 105/243 |
| 3,110,270 | A * | 11/1963 | Ingram | 105/253 |
| 3,133,509 | A * | 5/1964 | Farmer | 105/253 |
| 3,138,116 | A * | 6/1964 | Dorey | 105/253 |
| 3,255,553 | A * | 6/1966 | Dorey | 105/282.1 |
| 3,255,714 | A * | 6/1966 | Dorey | 105/253 |
| 3,344,748 | A * | 10/1967 | Dorey | 105/282.1 |
| 3,348,501 | A * | 10/1967 | Stevens et al. | 105/248 |
| 3,450,064 | A * | 6/1969 | Floehr et al. | 105/282.1 |
| 3,543,691 | A * | 12/1970 | Nagy | 105/241.2 |
| 3,577,680 | A * | 5/1971 | Nagy | 49/358 |
| 3,581,673 | A * | 6/1971 | Danielson | 105/253 |
| 3,611,947 | A * | 10/1971 | Nagy | 105/253 |
| 3,631,812 | A * | 1/1972 | Winslow, Jr. | 105/240 |
| 3,709,152 | A * | 1/1973 | Gutridge | 105/253 |
| 3,780,672 | A * | 12/1973 | Fuller | 105/253 |
| 3,815,514 | A * | 6/1974 | Heap | 105/240 |
| 3,831,803 | A * | 8/1974 | Hutchison et al. | 220/378 |
| 3,837,294 | A * | 9/1974 | Fossett | 105/253 |
| 4,009,906 | A * | 3/1977 | Sweet et al. | 298/27 |
| 4,236,458 | A * | 12/1980 | Varda | 105/310.2 |
| 4,574,989 | A * | 3/1986 | Pole | 222/486 |
| 6,412,421 | B2 * | 7/2002 | Dohr et al. | 105/282.2 |
| 6,412,422 | B2 * | 7/2002 | Dohr et al. | 105/282.3 |
| 6,637,346 | B2 * | 10/2003 | Gaydos | 105/247 |
| 6,736,072 | B2 * | 5/2004 | Degelman et al. | 105/258 |

(Continued)

OTHER PUBLICATIONS

U.S. Appl. No. 12/077,899, Stephen R. Early.

*Primary Examiner*—S. Joseph Morano
*Assistant Examiner*—Jason C Smith
(74) *Attorney, Agent, or Firm*—Stinson Morrison Hecker LLP

(57) ABSTRACT

A hopper car gate for discharging cargo from a hopper car having a length greater than its width. The gate has opposed generally upright side walls and opposed generally upright end walls coupled with the side walls. The coupled walls present a top opening and a bottom opening. A first rail extends between and is coupled with the side walls adjacent the bottom opening. A first door is supported on the first rail and is moveable in a direction that is perpendicular to the length of the hopper car that the gate is joined with between a closed position which blocks the bottom opening and an open position which allows cargo to exit through the bottom opening.

23 Claims, 6 Drawing Sheets

U.S. PATENT DOCUMENTS

| | | | | |
|---|---|---|---|---|
| 6,932,433 | B2 * | 8/2005 | Heider et al. | 298/27 |
| 7,124,693 | B2 * | 10/2006 | Lucas | 105/282.2 |
| 2005/0081741 | A1 * | 4/2005 | Fortuna | 105/280 |
| 2005/0166788 | A1 * | 8/2005 | Early | 105/247 |
| 2005/0263031 | A1 * | 12/2005 | Early | 105/247 |
| 2009/0007813 | A1 * | 1/2009 | Early | 105/253 |

* cited by examiner

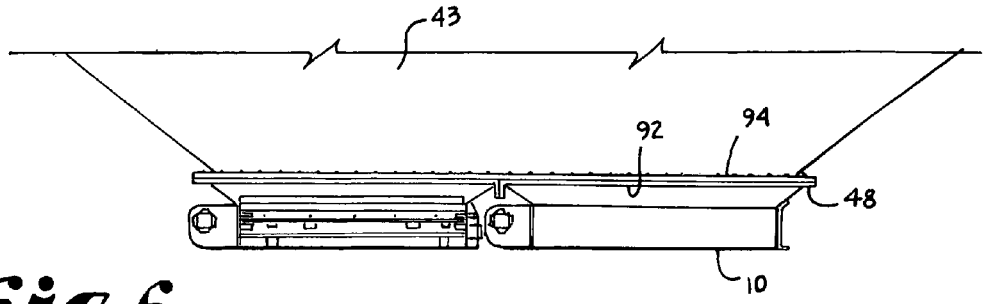
Fig. 6.
Fig. 7.
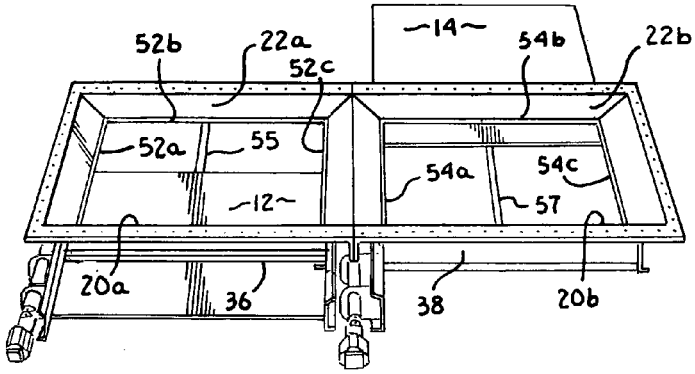
Fig. 8.
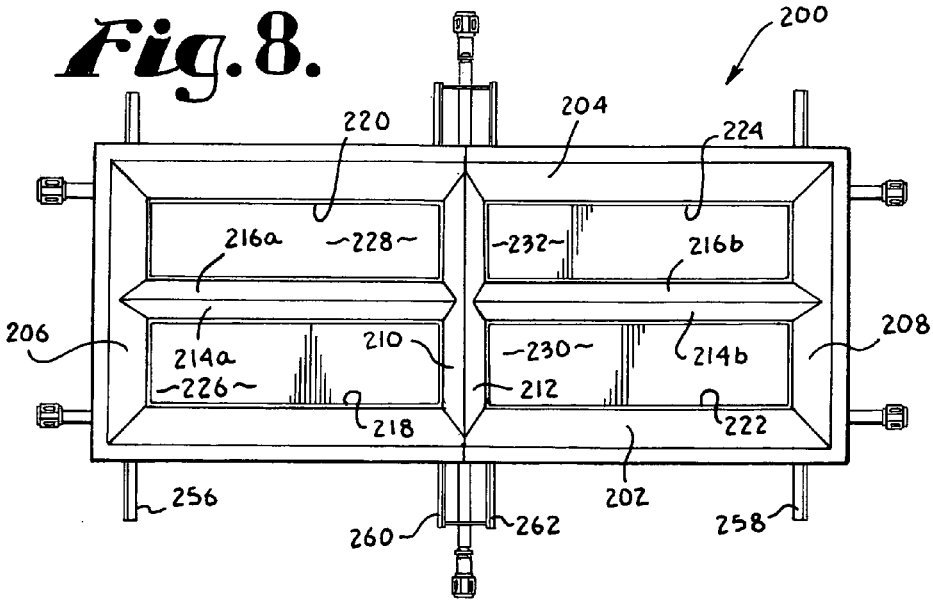

HOPPER CAR GATE WITH A LATERALLY OPENING DOOR

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention is related in general to a hopper car for carrying bulk materials and more particularly to a hopper car gate with a laterally opening door.

2. Description of Related Art

Hopper cars are commonly used to transport bulk materials. Hopper cars include one or more hoppers which hold bulk materials or other cargo for shipment. Each hopper has a discharge opening at its bottom in order to discharge the cargo upon arrival at its intended destination. A gate is joined to each opening to control the discharge of cargo from the hopper. Typically, the gate will have a frame defining an opening and a door moveable between a closed position which blocks the opening and an open position which allows cargo to exit through the opening. An opening mechanism allows a user to move the door between its closed and open positions.

The hopper openings must be spaced a distance sufficient to allow clearance for opening the doors of the gates joined to the openings. Between adjacent hopper openings there are sloped hopper surfaces to facilitate discharge of the cargo within the hoppers. The area beneath the sloped surfaces is wasted space. Reducing the spacing between adjacent hopper openings reduces the wasted space beneath the sloped hopper surfaces, thus increasing the hopper car's carrying capacity. The length or width of hopper cars cannot be increased to increase carrying capacity because there are maximum exterior dimensions to which hopper cars must conform. For example, the Association of American Railroads (AAR) establishes maximum clearance dimensions for all railcars including hopper cars. It is important to maximize a hopper car's carrying capacity while ensuring the car has dimensions within the specified maximum clearance dimensions.

Some commonly transported bulk materials have difficulty exiting through standard hopper gates. In particular, dried distillers' grains, which are a byproduct of ethanol production from corn, are sticky and may form clumps blocking the opening of a standard hopper gate. A bigger discharge opening is needed to effectively discharge sticky cargo such as dried distillers' grains.

BRIEF SUMMARY OF THE INVENTION

The present invention is directed toward a hopper car gate for discharging cargo from a hopper car having a length greater than its width. The gate comprises coupled side and end walls presenting a top opening, bottom opening, and upper surface adapted to be joined to the hopper car. At least one rail is coupled with the side walls adjacent the bottom opening. Preferably, two rails are coupled with the side walls adjacent the bottom opening. The rails support a door that is moveable in a direction perpendicular to the length of the car that the gate is joined with.

In another embodiment of the hopper car gate according to the present invention, the gate comprises side and end walls presenting a top opening and a bottom opening with two sections. A first rail is coupled with the side walls adjacent the first section of the bottom opening and supports a first door that is moveable in a direction perpendicular to the length of the car that the gate is joined with. A second rail is coupled with the side walls adjacent the second section of the bottom opening and supports a second door that is moveable in the opposite direction as the first door. The first door blocks the first section of the bottom opening when in its closed position, and the second door blocks the second section of the bottom opening when in its closed position.

The present invention is also directed toward a drive system for opening and closing doors on first and second adjacent hopper car gates. Each gate comprises coupled side and end walls presenting a top opening and a bottom opening. At least one rail and preferably two rails are coupled with opposite walls adjacent the bottom opening. A door is supported on the rails and is moveable between a closed position and an open position. At least one gear rack and preferably two gear racks are mounted on the door in a direction parallel to the direction of movement of the door, a shaft extends in a direction perpendicular to the direction of movement of the door, and one or more gears are mounted on the shaft to engage each gear rack. The drive system comprises a main drive shaft positioned between the door on the first gate and the door on the second gate. The main drive shaft is coupled with the shaft on each of the adjacent gates such that rotation of the main drive shaft moves the door of each of the gates between the open and closed positions.

Because the doors open in a direction that is perpendicular to the length of the car that the gates are joined to, there is no interference between open doors of adjacent gates. Because there is no interference, there is no spacing required between adjacent hopper gates. Thus, the cargo carrying capacity of a hopper car may be greatly increased by using gates of the present invention rather than conventional hopper car gates. Without interference between adjacent gates, the hopper openings may also be enlarged to facilitate the discharge of sticky substances. Further, the drive system according to the present invention eliminates the need to rotate a shaft for each individual gate or door when opening or closing that gate or door.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

BRIEF DESCRIPTION OF THE DRAWINGS

FIG. 6 is a side elevational view of the gate of FIG. 1 joined with a railcar hopper;

FIG. 7 is a perspective view of the gate of FIG. 1 showing doors in an open position;

FIG. 8 is a top plan view of a hopper car gate according to another embodiment of the present invention;

DETAILED DESCRIPTION OF PREFERRED EMBODIMENT

Figure 1:
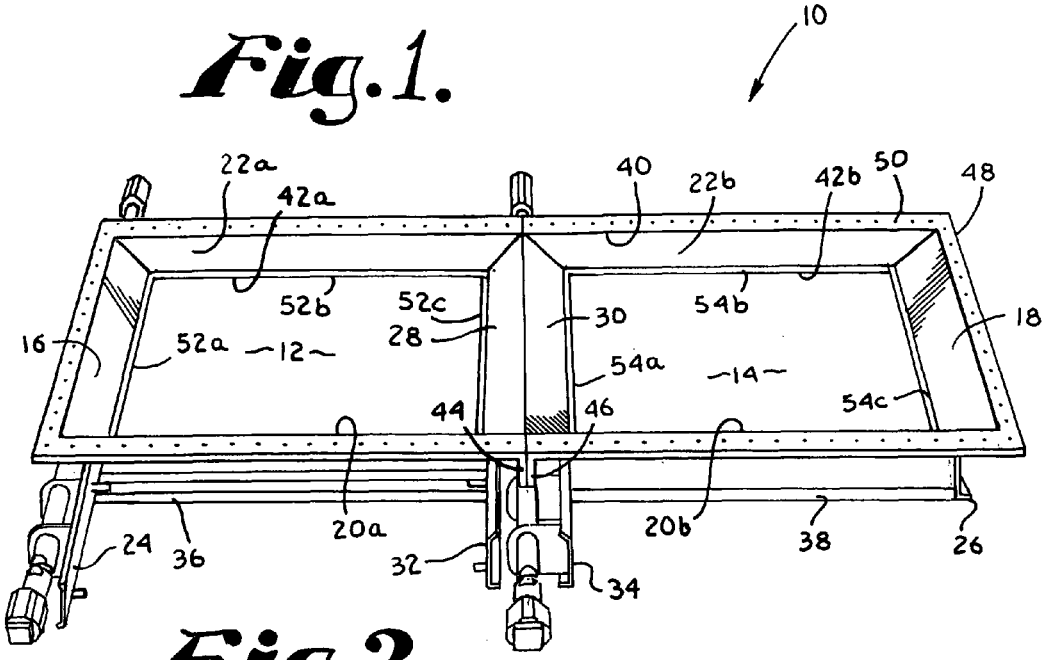
FIG. 1 is a perspective view of a hopper car gate according to one embodiment of the present invention.

A hopper car gate 10 with laterally opening doors 12 and 14 in accordance with one aspect of the present invention is shown in FIG. 1. The gate has first and second end walls 16 and 18 joined with side walls 20*a-b* and 22*a-b*. End frame members 24 and 26 support and are joined with end walls 16 and 18 respectively. A first dividing wail 28 extends between and is joined with side walls 20*a* and 22*a*, and a second dividing wall 30 extends between and is joined with side walls 20*b* and 22*b*. First and second dividing walls 28 and 30 are positioned between doors 12 and 14. First and second center frame members 32 and 34 support and are joined with first and second dividing walls 28 and 30 respectively. A side frame member 36 extends between and is joined with frame members 24 and 32, and another side frame member 38 extends between and is joined with frame members 26 and 34. There is also a side frame member (not shown) positioned beneath side wall 22*a* that extends between frame members 24 and 32, and another side frame member (not shown) positioned beneath side wall 22*b* that extends between frame members 26 and 34. The side and center frame members are not shown in the cut away section of FIG. 4 in order to clearly show the gate's drive mechanism. The gate has a top opening 40 and a bottom opening with first and second sections 42*a* and 42*b*.

As shown in FIG. 1, first door 12 blocks the first section 42*a* of the bottom opening and second door 14 blocks the second section 42*b* of the bottom opening when the doors are in the closed position. FIG. 7 shows doors 12 and 14 in a partially open position for allowing cargo to exit through first and second sections 42*a* and 42*b* of the bottom opening when the gate is mounted to a hopper 43, as shown in FIG. 6. Doors 12 and 14 move from the closed position to the open position in opposite directions.

Figure 2:
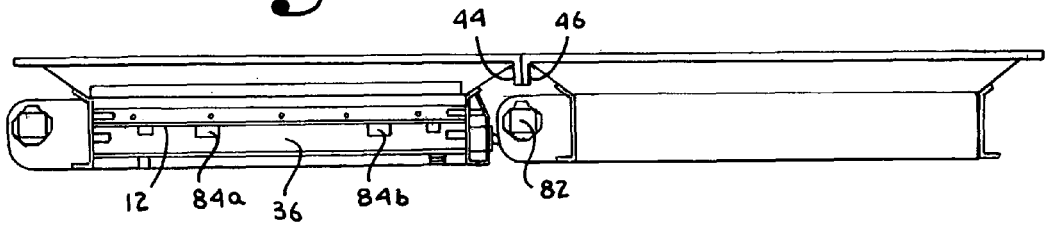
FIG. 2 is a side elevational view of the gate of FIG. 1.
Figure 4:
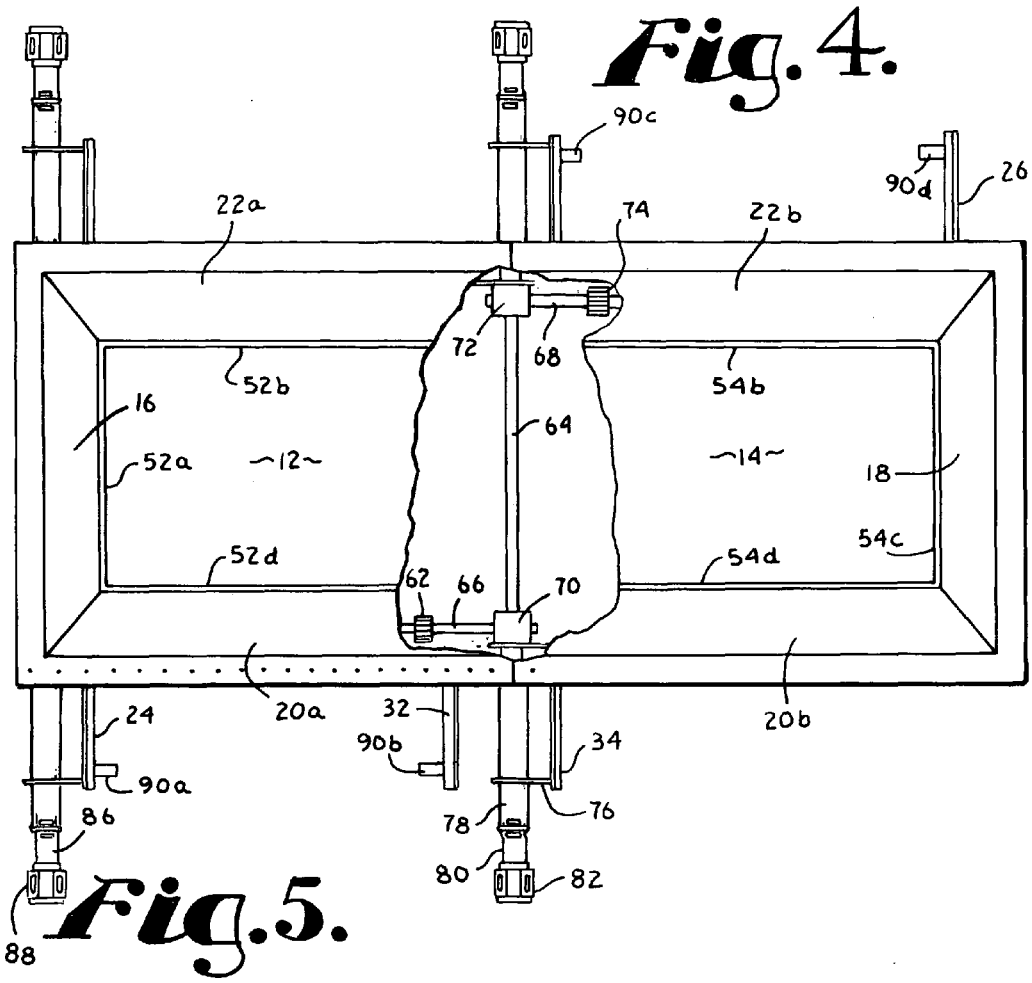
FIG. 4 is a top plan view of the gate of FIG. 1, with portions broken away, showing the gate's drive shafts and gears.

As shown in FIGS. 1 and 2, mating surfaces 44 and 46 extend downward from the top of dividing walls 28 and 30 respectively. Each mating surface 44 and 46 preferably has a plurality of aligned openings (not shown) which receive fasteners (not shown), such as bolts or rivets, for joining the surfaces. Surfaces 44 and 46 may also be joined by welding or some other means known in the art. As shown in FIG. 1, flange 48 is joined with an upper surface of side walls 20*a-b* and 22*a-b* adjacent top opening 40. Flange 48 has equidistant spaced holes 50 which preferably receive fasteners (not shown) to join the gate to a hopper, as shown in FIG. 6. Although the gate is shown with a flange 48, it is within the scope of the invention for the gate to not have a flange and to be joined with a hopper by welding or some other means known in the art. As shown in FIGS. 1 and 4, flexible seals 52*a*, 52*b*, 52*c* and 52*d* are mounted to walls 16, 22*a*, 28 and 20*a* respectively. Likewise, flexible seals 54*a*, 54*b*, 54*c* and 54*d* are mounted to walls 30, 22*b*, 18 and 20*b* respectively. Seals 52*a-d* and 54*a-d* prevent cargo from leaking through sections 42*a* and 42*b* of the bottom opening when doors 12 and 14 are in the closed position. The seals are preferably constructed from ultra-high molecular weight polyethylene, however, it is within the scope of the invention for the seals to be constructed from another suitable material.

As shown in FIG. 7, a rail 55 extends between side walls 20*a* and 22*a* for supporting door 12. There are two additional rails (not shown) that support door 12 positioned beneath seals 52*a* and 52*c*. There are also three similar rails, one of which is shown as 57, extending between side walls 20*b* and 22*b* for supporting door 14. Each of the door supporting rails is rigidly joined with opposite side frame members, two of which are shown as 36 and 38 in FIG. 1. A circular rod (not shown) is preferably welded to the top of each rail. Each rod presents a low-friction glide surface to facilitate sliding the door on the rod. The rods are preferably made of bronze or a similar material which generates a relatively low amount of friction with the door. Although, rails 55 and 57 are shown and described as being substantially identical, it is within the scope of the invention for the rails to have differing configurations.

As shown in FIG. 4, the gate has first, second and third drive shafts 64, 66 and 68 respectively. First and second drive shafts 64 and 66 are coupled by a first right angle gear box 70, and first and third drive shafts 64 and 68 are coupled by a second right angle gear box 72. The right angle gear boxes, or gear sets, may use worm gears, helical gears, bevel gears, hypoid gears, or any other set of gears operable to transfer torque between perpendicular shafts. One suitable right angle gear box is sold under the trade name Slide-Rite by Tolomatic, Inc. of Hamel, Minn. While first drive shaft 64 extends in a direction parallel to the direction of movement of doors 12 and 14, second and third drive shafts 66 and 68 extend in a direction that is perpendicular to the direction of movement of the doors. First drive shaft 64 is positioned between first and second doors 12 and 14.

Figure 5:
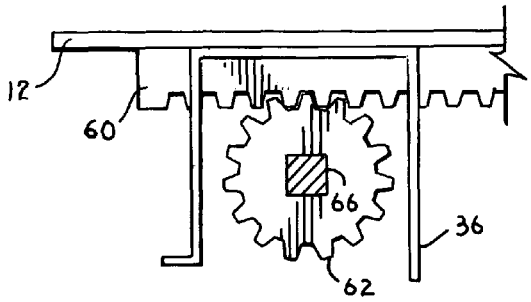
FIG. 5 is a sectional view of a portion of the gate of FIG. 1 showing a gear engaged with a gear rack mounted on the bottom of a door.

As shown in FIG. 4, a first gear 62 is mounted on second drive shaft 66 and a second gear 74 is mounted on third drive shaft 68. As shown in FIG. 5, a gear rack 60 is mounted on the bottom surface of door 12. The gear rack 60 extends the length of door 12 in a direction aligned with the direction of movement of the door. Gear 62 engages gear rack 60 for opening and closing door 12. There is a similar gear rack (not shown) mounted on the bottom surface of door 14 that engages second gear 74 for moving door 14. Additionally, there is preferably a third gear (not shown) mounted on first drive shaft 66, which is engaged with another gear rack (not shown) mounted on the bottom of door 12 and a fourth gear (not shown) mounted on third drive shaft 68, which is engaged with another gear rack (not shown) on the bottom of door 14. It is also within the scope of the invention for any of the gear racks to be mounted on the top surface of the doors.

Figure 3:
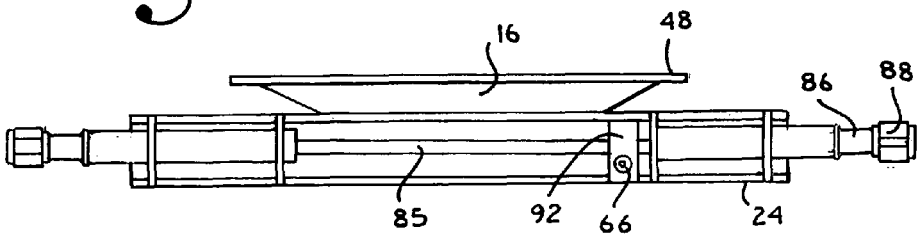
FIG. 3 is a front elevational view of the gate of FIG. 1.

As shown in FIG. 4, a support structure 76 extends from frame member 34 and is joined with a bearing sleeve 78. A coaxial shank 80 is received by sleeve 78. The shank has a socket 82 joined to its outer end. First drive shaft 64 is secured to shank 80 such that it rotates with shank 80 and socket 82. Sleeve 78 prevents deflection of shaft 64. The opposite end of driveshaft 64 has a similar configuration with a support structure, bearing sleeve, shank and socket as described above. There is also a shaft 85, shown in FIG. 3, joined with a shank 86 and a socket 88 on the other side of door 12 from shaft 64. Shaft 85 is coupled with second drive shaft 66 via another right angle gear box 92. Shaft 85 is optional and is not necessary to operate the gate. The shaft is preferably used only if right angle gear box 70 is inoperable, or is not a part of the gate. In this embodiment, shaft 64 operates door 14, and shaft 85 operates door 12.

Referring now to FIG. 2, there are two stoppers 84*a* and 84*b* mounted on the bottom surface of door 12. The stoppers abut side frame member 36 when the door is in its closed position. There are also two stoppers (not shown) mounted on the bottom surface of door 14. As shown in FIG. 4, there are opposed pins 90*a* and 90*b* coupled with and extending inward from each of frame members 24 and 32 for supporting door 12 when the door is in the open position. There are two additional pins 90*c* and 90*d* coupled with frame members 34 and 26 for supporting door 14 when the door is in the open position.

Although not shown, the gate may have additional support structures to improve rigidity or prevent deflection of shafts 64, 66, 68, and 85. For instance, there may be sleeves which surround at least a portion of shafts 64, 66, 68, and 85 for preventing deflection of the shafts. These sleeves may be joined with any of the frame members via support structures. Additionally, the second and third drive shafts 66 and 68 may extend beyond end frame members 24 and 26 respectively and sockets may be coupled with the ends of the drive shafts as a backup mechanism for opening and closing the doors.

FIG. 6 shows gate 10 joined with a cargo containing hopper 43. The hopper has an opening 92 and a flange 94 surrounding the opening. Preferably, the flange has a plurality of holes (not shown) which align with flange holes 50, shown in FIG. 1. The aligned holes receive fasteners (not shown) securing the gate to the hopper. Although the gate is shown with a flange, it is within the scope of the invention for the gate to not have a flange and for the upper surfaces of the joined walls to be joined with the rim surrounding a hopper opening by welding or any other means known in the art. Gate 10 is mounted to hopper 43 such that the doors 12 and 14 move toward and away from the side walls of the hopper. Thus, the doors move toward and away from a person viewing the hopper car from its side. Hopper 43 is a part of a hopper car having a length greater than its width. The side walls of the hopper extend in the same direction as the length of the hopper car such that the doors move in a direction that is perpendicular to the length of the car.

Figure 9:
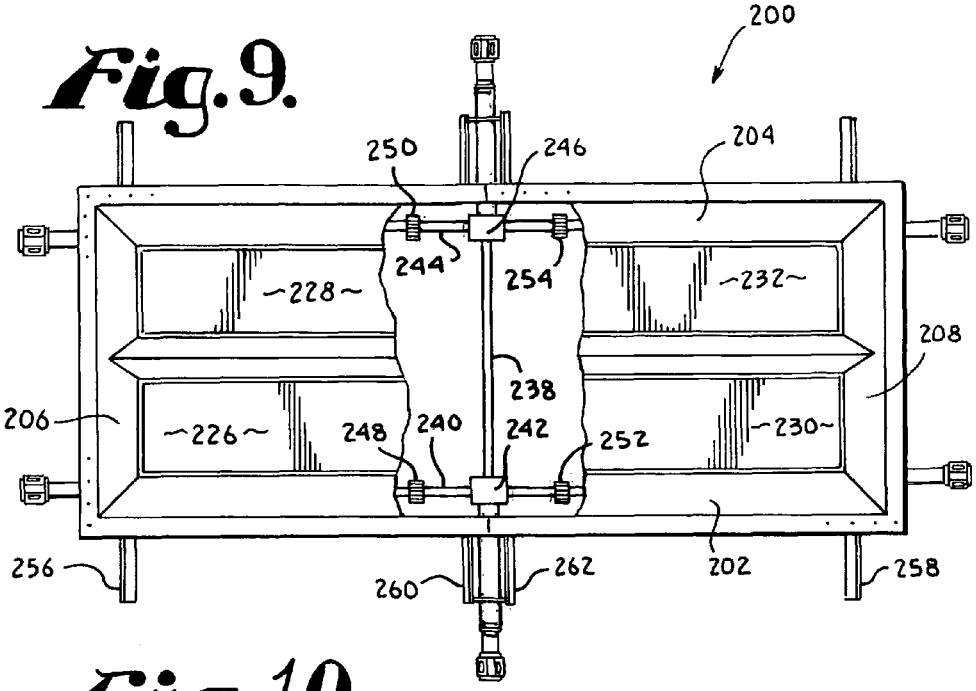
FIG. 9 is a top plan view of the gate of FIG. 8, with portions broken away, showing the gate's drive shafts and gears.
Figure 10:
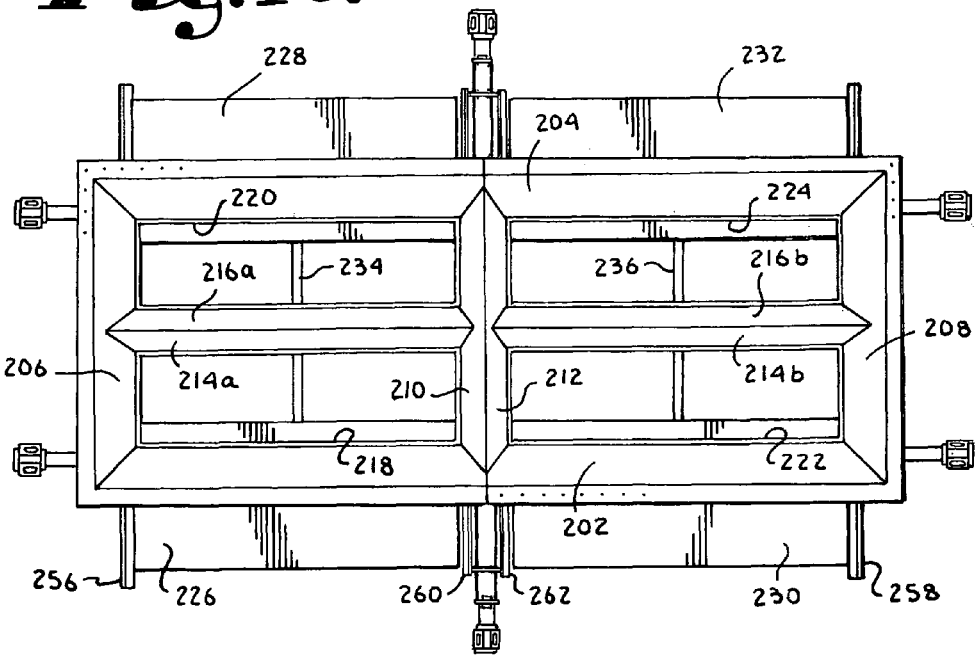
FIG. 10 is a top plan view of the gate of FIG. 8 showing doors in an open position.

FIGS. 8-10 show an alternative embodiment of a hopper car gate 200 according to the present invention. Gate 200 has side walls 202 and 204 and end walls 206 and 208 joined with the side walls. First and second dividing walls 210 and 212 are joined with and extend between the mid portion of the side walls. Third and fourth dividing walls 214*a-b* and 216*a-b* extend between end walls 206 and 208. As shown in FIG. 8, third and fourth dividing walls are discontinuous because they are interrupted by first and second dividing walls 210 and 212. A first section of each of third and fourth dividing walls 214*a* and 216*a* extends between and is joined with end wall 206 and dividing wall 210, and a second section of each of third and fourth dividing walls 214*b* and 216*b* extends between and is joined with end wall 208 and dividing wall 212.

The walls present a bottom opening having first, second, third, and fourth sections 218, 220, 222, and 224 respectively. First, second, third, and fourth doors 226, 228, 230, and 232 block the first, second, third, and fourth openings when in the closed position as shown in FIG. 8. The doors allow cargo to exit through the openings when in the partially open position shown in FIG. 10. As shown in FIG. 10, a first rail 234 extends between side walls 202 and 204 for supporting doors 226 and 228, and a second rail 236 extends between side walls 202 and 204 for supporting doors 230 and 232. These rails are substantially similar to the rails described above in connection with gate 10 shown in FIGS. 1-7. Although not shown, the gate preferably has two additional rails for supporting both of doors 226 and 228, and two additional rails for supporting both of doors 230 and 232. As described above in connection with gate 10 shown in FIGS. 1-7, each rail of gate 200 is preferably joined with opposed side frame members (not shown) that are positioned below each side wall. The side frame members of gate 200 are preferably substantially similar to side frame member 36 of gate 10.

As shown in FIG. 9, a first drive shaft 238 extends through the center of the gate between doors 226 and 228 and doors 230 and 232. A second drive shaft 240 is coupled with first drive shaft 238 by a first right angle gear box 242, and a third drive shaft 244 is coupled with first drive shaft 238 by a second right angle gear box 246. Drive shafts 240 and 244 could each be split into two shafts coupled at the respective gear box 242 or 246. A first gear 248 is mounted on second drive shaft 240, a second gear 250 is mounted on third drive shaft 244, a third gear 252 is mounted on second drive shaft 240, and a fourth gear 254 is mounted on third driveshaft 244. Each gear engages a gear rack that is mounted on the bottom of the door positioned above the gear, as discussed above in connection with gate 10 and shown in FIG. 5. Gate 200 preferably also has two additional gears mounted on each of the second and third drive shafts 240 and 244 each engaging a gear rack mounted on the bottom surface of one of the doors. It is within the scope of the invention for the racks to be mounted on the top surfaces of each of the doors. As shown in FIGS. 8-10, there is a socket joined with each end of each shaft for receiving a tool to rotate the drive shafts.

Gate 200 has end frame members 256 and 258 supporting and joined with end walls 206 and 208 respectively. Center frame members 260 and 262 also support and are joined with first and second dividing walls 210 and 212 respectively. Although not shown, there are also side frame members extending between end frame members 256 and 258 beneath both side walls 202 and 204. The side frame members are joined with the end frame members 256 and 258 and the center frame members 260 and 262. The side frame members are preferably similar to side frame member 36 discussed above in connection with gate 10. There are also preferably frame members (not shown) supporting and joined with third and fourth dividing walls 214*a-b* and 216*a-b*. These frame members are joined with the end frame members 206 and 208 and the center frame members 210 and 212. The gate also preferably has bearing sleeves surrounding at least a portion of each drive shaft for preventing deflection of the drive shafts and support structures joining the bearing sleeves with the frame members as discussed above in connection with gate 10. The center and side frame members are not shown in the cut away portion of FIG. 9 in order to clearly show the gate's drive mechanism.

Figure 11:
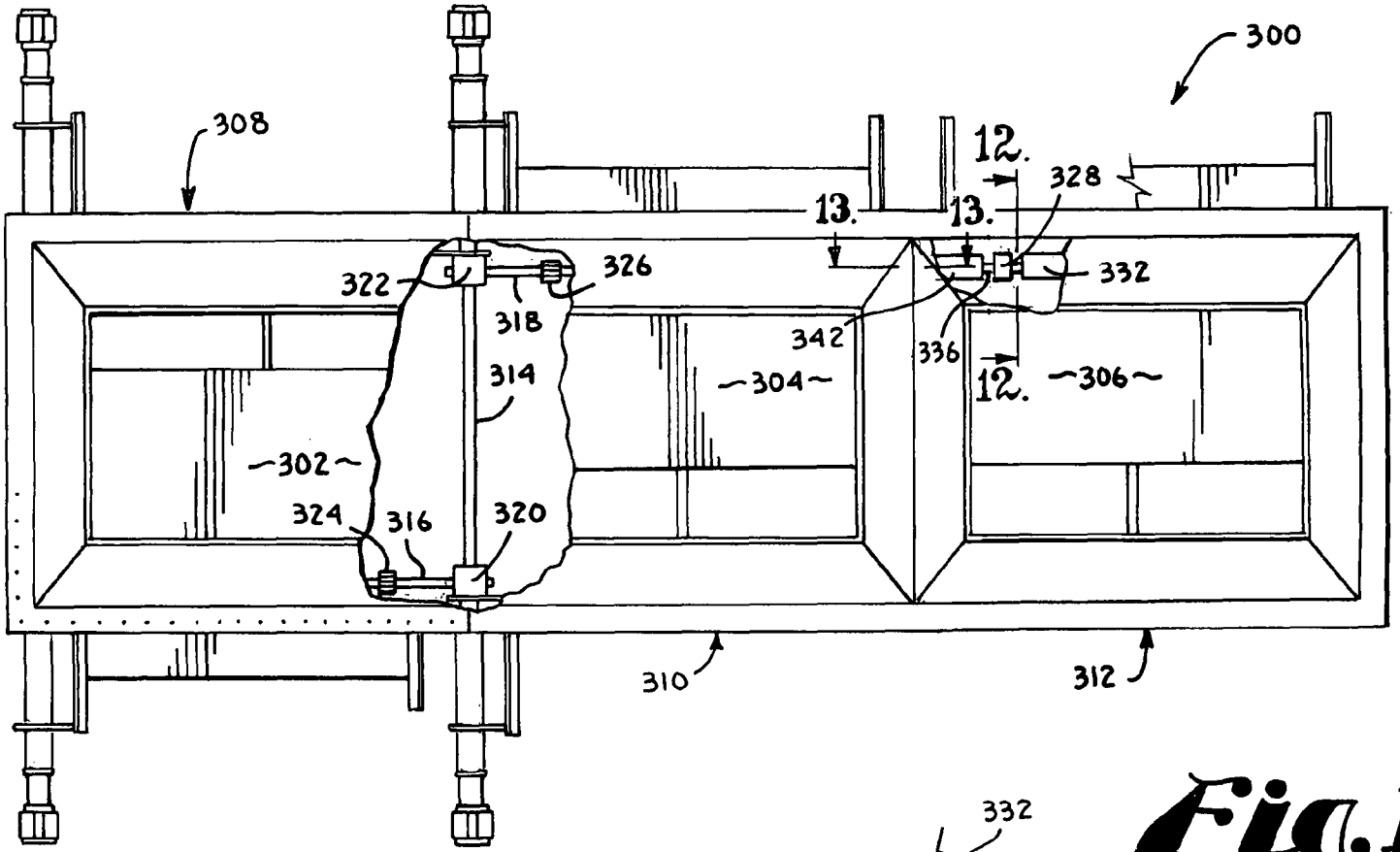
FIG. 11 is a top plan view of a hopper car gate according to another embodiment of the present invention.
Figure 12:
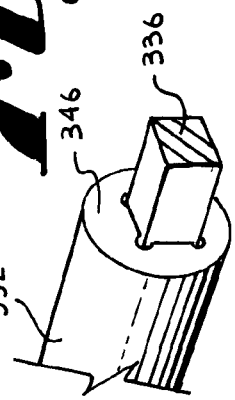
FIG. 12 is a perspective view of a shaft and torque tube of the gate of FIG. 11 taken through line 12-12 in FIG. 11.
Figure 13:
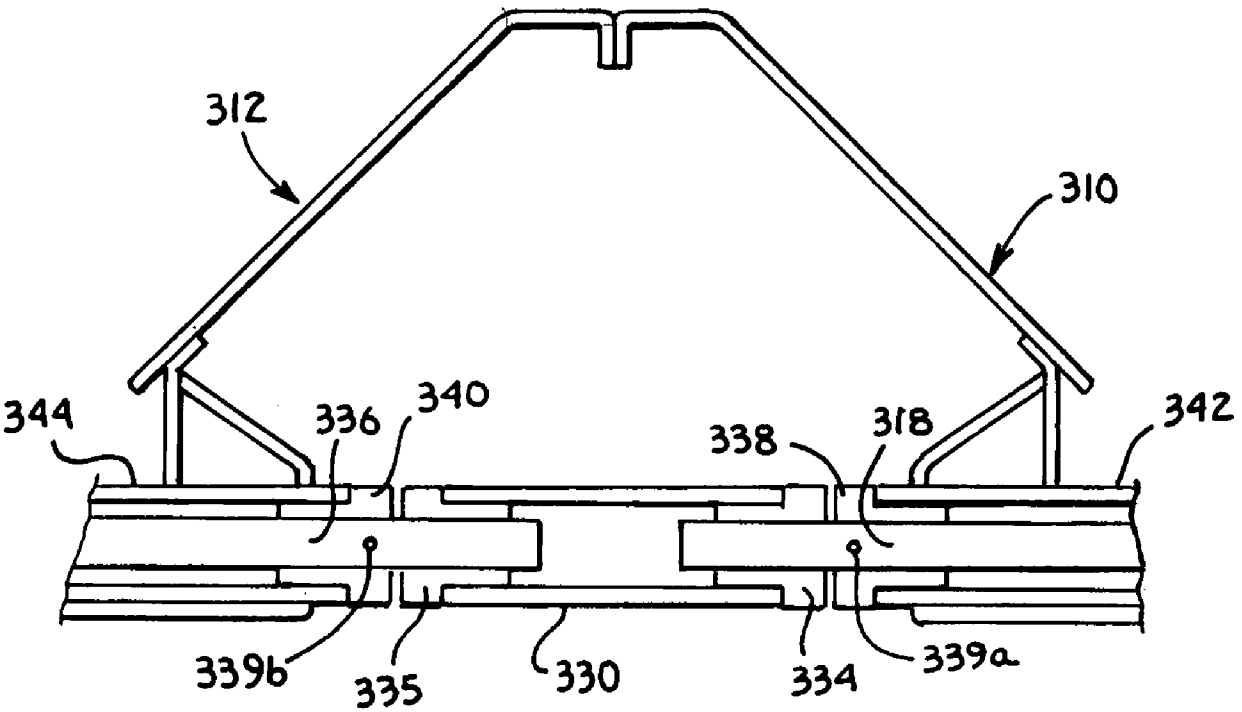
FIG. 13 is a cross-sectional view taken through line 13-13 in FIG. 11.

FIGS. 11-13 show a drive system 300 for opening and closing doors 302, 304, and 306 on first, second, and third hopper car gates 308, 310, and 312. In combination, gates 308 and 310 preferably have the same structure as gate 10 discussed above and shown in FIG. 1. Gate 308 has a drive shaft 316 and a gear 324 mounted on the drive shaft which engages a rack (not shown) mounted to the bottom of door 302. Likewise, gate 310 has a drive shaft 318 and a gear 326 which engages a rack (not shown) mounted to the bottom of door 304, and gate 312 has a drive shaft 336 and a gear 328 which engages a rack (not shown) mounted to the bottom of door 306. First and second hopper car gates 308 and 310 preferably have mating flanges (not shown) similar to mating flanges 44 and 46 of gate 10, and second and third hopper car gates 310 and 312 also preferably have mating flanges (not shown) similar to the mating flanges of gate 10.

Drive system 300 comprises a main drive shaft 314 positioned between doors 302 and 304. A first right angle gear box 320 couples main drive shaft 314 with drive shaft 316, and a second right angle gear box 322 couples main drive shaft 314 with drive shaft 318. Preferably, there is an additional gear (not shown) mounted on each of shafts 316, 318, and 336 that is engaged with an additional rack (not shown) mounted on the bottom surface of each door 302, 304, and 306. Drive shafts 318 and 336 are joined via a coupler 330, shown in FIG. 13. Caps 334 and 335 are rigidly joined with opposite ends of the coupler and each has an opening that is slightly larger than a cross-section of shafts 318 and 336 for receiving the shafts. Coupler 330 transmits torque from shaft 318 to shaft 336. End caps 338 and 340 are joined to the end of each shaft 318 and 336 with set screws 339*a* and 339*b*, for preventing the shafts from moving axially within bearing tubes 342 and 344. Shafts 318 and 336 may be joined to end caps 338 and 340 by any means known in the art.

Referring now to FIGS. 11 and 12, a torque tube 332 encloses shaft 336 between gear 328 and another gear (not shown) mounted to the opposite end of shaft 336 for preventing shaft deformation. As shown in FIG. 12, torque tube 332 has a cap 346 with an opening that is slightly larger than a cross-section of shaft 336 for receiving the shaft. The tube has another cap (not shown) at the other end of the torque tube. Caps 334, 335, 338, and 340 preferably have a similar construction as cap 346 shown in FIG. 12. As shown in FIG. 12, shaft 336 has a square cross-section. Although shaft 336 is shown with a square cross-section, it is within the scope of the invention for the shaft to have a cross-section of any shape. Preferably, however, the shaft has a non-circular cross-section for transferring torque to the torque tube through the caps at the ends of the tube. If desirable, the other shafts of the gate may have torque tubes for preventing deformation.

In operation, to open doors 12 and 14 of gate 10, shown in FIGS. 1-7, an opening tool is inserted into socket 82 for rotating shaft 64 in a clockwise direction (as viewed from FIG. 2). First right angle gear box 70 is configured for right-hand drive such that shaft 66 rotates in a counter-clockwise direction (as viewed from FIG. 5). Gear 62 rotates in a counter-clockwise direction and drives rack 60 to the left (as viewed from FIG. 5), thus moving door 12 to its open position. Second right angle gear box 72 is configured for left-hand drive such that shaft 68 rotates in a counter-clockwise direction (as viewed from FIG. 3). Gear 74 rotates and drives the rack mounted on the bottom of door 14 upward (as viewed from FIG. 4), thus moving door 14 to its open position.

When the doors are in the open position the cargo contained in hopper 43, shown in FIG. 6, exits through the bottom opening of the gate. After the cargo is released, socket 82 is rotated in a counter-clockwise direction (as viewed from FIG. 2) to close both doors. Alternatively, if gearbox 70 is inoperable or otherwise not included with the gate, then socket 82 opens and closes door 14, while socket 88 opens and closes door 12.

Gate 200, shown in FIGS. 8-10, operates in substantially the same manner as gate 10 described above. First, shaft 238 is rotated in a clockwise direction (as viewed from side wall 202) by inserting an opening tool in either of the sockets at the ends of shaft 238. First right angle gear box 242 is configured for right-hand drive so shaft 240 rotates in a clockwise direction (as viewed from end wall 206). Gears 248 and 252 drive racks (not shown) mounted on the bottom of doors 226 and 230 downward (as viewed from FIG. 9), thus opening the doors. Second right angle gear box 246 is configured for left-hand drive so shaft 244 rotates in a counter-clockwise direction (as viewed from end wall 206). Gears 250 and 254 then drive racks (not shown) mounted on the bottom of doors 228 and 232 upward (as viewed from FIG. 9), thus opening the doors. The doors are closed by rotating shaft 238 in the counter-clockwise direction (as viewed from side wall 202). The doors on the gate may also be opened by rotating any of the sockets mounted on the ends of shafts 240 and 244, although these sockets are preferably used to open one of the respective doors when one of the gear boxes is inoperable. As shown in FIG. 10, doors 226 and 230 move in the opposite direction as doors 228 and 232. Like the doors of gate 10, discussed above, all of the doors of gate 200 move in a direction that is perpendicular to the length of the hopper car that the gate is mounted to.

Gate 300, shown in FIGS. 11 and 12, operates in substantially the same manner as gate 10 described above, except that rotation of shaft 314 causes three doors to open. Gear 324 engages a rack (not shown) mounted on the bottom of door 302 to open the door, gear 326 engages a rack (not shown) mounted on the bottom of door 304 to open the door, and gear 328 engages a rack (not shown) mounted on the bottom of door 306 to open the door. As shown in FIG. 11, doors 304 and 306 both move in the same direction, while door 302 moves in the opposite direction. All three of the doors move in a direction that is perpendicular to the length of the hopper car that the gate is mounted to as discussed above in connection with gate 10.

From the foregoing it will be seen that this invention is one well adapted to attain all ends and objectives herein-above set forth, together with the other advantages which are obvious and which are inherent to the invention. For instance, the gates described above allow for closer spacing between adjacent hopper gates because there is no interference between open doors of adjacent gates. Therefore, a hopper car using one of the gates described above may have more cargo carrying capacity. Further, the gates described above allow for larger hopper openings which facilitate the discharge of sticky substances. The drive system according to the present invention also eliminates the need to rotate a shaft for each individual gate or door when opening or closing that gate or door. Additionally, the torque tube described herein prevents shaft deformation for longer shafts and shafts transmitting torque to doors with large surface areas.

Since many possible embodiments may be made of the invention without departing from the scope thereof, it is to be understood that all matters herein set forth or shown in the accompanying drawings are to be interpreted as illustrative, and not in a limiting sense. For instance, even though all of the gates have doors with a gear rack mounted on the door that engages with a gear to open and close the doors, it is within the scope of the invention for the doors to be operated in another manner. For example, the doors could be moved with a screw drive actuator, or a pneumatic or hydraulic push-pull cylinder.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A hopper car gate for discharging cargo from a hopper car having a length greater than its width, said car comprising a hopper having an opening and a rim surrounding said opening, said gate comprising:

opposed generally upright side walls;

opposed generally upright end walls coupled with said side walls, wherein said coupled side and end walls present a top opening, a bottom opening, and an upper surface surrounding said top opening, wherein said upper surface is adapted to be joined to the rim of the car;

a rail extending between and coupled with said side walls adjacent said bottom opening;

a door supported on said rail and moveable in a direction that is perpendicular to the length of the car between a closed position which blocks said bottom opening and an open position which allows the cargo to exit through said bottom opening;

a gear rack mounted on said door, said rack extending in a direction parallel to the direction of movement of said door;

a first drive shaft extending in a direction parallel to the direction of movement of said door;

a second drive shaft coupled with and extending in a direction perpendicular to said first drive shaft; and a gear mounted on said second drive shaft and engageable with said gear rack.

2. The gate of claim 1, wherein said bottom opening comprises first and second sections, said rail comprises a first rail, and said door comprises a first door which blocks said first section when in its closed position, said gate further comprising:

a second rail extending between and coupled with said side walls adjacent said bottom opening; and a second door supported on said second rail and moveable in a direction that is perpendicular to the length of the car between a closed position which blocks said second section of said bottom opening and an open position which allows the cargo to exit through said second section of said bottom opening.

3. The gate of claim 2, wherein said first and second doors are moveable in opposite directions.

4. The gate of claim 1, further comprising:

a right angle gear box coupling said first and second drive shafts.

5. The gate of claim 1, further comprising a flange coupled with said upper surface of said side and end walls, wherein said flange is adapted to be joined to the rim of the car.

6. A drive system for opening and closing doors on first and second adjacent hopper car gates, wherein each gate comprises opposed generally upright side walls coupled with opposed generally upright end walls presenting a top opening, a bottom opening, and an upper surface surrounding said top opening; a rail extending between and coupled with opposite walls adjacent said bottom opening; a door supported on said rail and moveable between a closed position blocking said bottom opening and an open position allowing cargo to exit through said bottom opening; a gear rack mounted on said door in a direction parallel to the direction of movement of said door; a shaft extending in a direction perpendicular to the direction of movement of said door; and a gear mounted on said shaft and engageable with said gear rack; said drive system comprising:

a main drive shaft positioned between said door on said first gate and said door on said second gate and coupled with said shaft on each of said gates such that rotation of said main drive shaft is operable to move said door on each of said gates between the open and closed positions.

7. The drive system of claim 6, further comprising:

a first right angle gear box coupling said main drive shaft with said shaft on said first hopper car gate; and a second right angle gear box coupling said main drive shaft with said shaft on said second hopper car gate.

8. The drive system of claim 6, wherein said first and second hopper car gates have mating flanges.

9. The drive system of claim 6, further comprising a third hopper car gate adjacent to said second hopper car gate, said third gate comprising a door with a gear rack mounted on said door, and wherein said shaft on said second gate mounts a gear engageable with said gear rack on said door of said third gate.

10. The drive system of claim 9, further comprising a torque tube enclosing at least a portion of said shaft on said second gate.

11. The drive system of claim 10, wherein said shaft on said second gate has a non-circular cross section.

12. The drive system of claim 11, wherein said torque tube comprises an elongate tube with a cap coupled to each end of said tube, wherein each cap has an opening corresponding to said cross section of said shaft on said second gate such that rotation of said shaft on said second gate effects rotation of said torque tube.

13. A hopper car gate for discharging cargo from a hopper car having a length greater than its width, said car comprising a hopper having an opening and a rim surrounding said opening, said gate comprising:

opposed generally upright side walls;

opposed generally upright end walls coupled with said side walls, wherein said coupled side and end walls present a top opening, a bottom opening comprising first and second sections, and an upper surface surrounding said top opening, wherein said upper surface is adapted to be joined to the rim of the car;

first and second rails extending between and coupled with said side walls adjacent said bottom opening;

a first door supported on said first rail and moveable in a direction that is perpendicular to the length of the car between a closed position which blocks said first section of said bottom opening and an open position which allows the cargo to exit through said first section of said bottom opening;

a second door supported on said second rail and moveable in a direction that is perpendicular to the length of the car between a closed position which blocks said second section of said bottom opening and an open position which allows the cargo to exit through said second section of said bottom opening;

first and second gear racks mounted respectively on said first and second doors extending in a direction parallel to the direction of movement of said doors;

a first drive shaft extending in a direction parallel to the direction of movement of said doors, said first drive shaft positioned between said first and second doors;

second and third drive shafts each coupled with and extending in a direction perpendicular to said first drive shaft;

a first gear mounted on said second drive shaft and engageable with said first gear rack; and a second gear mounted on said third drive shaft and engageable with said second gear rack.

14. The gate of claim 13, further comprising:

a first right angle gear box coupling said first and second drive shafts; and a second right angle gear box coupling said first and third drive shafts.

15. The gate of claim 13, further comprising:

first and second dividing walls extending between and coupled with said side walls, wherein each of said dividing walls is positioned between said first and second doors; and a mating surface extending from each of said dividing walls.

16. The gate of claim 15, further comprising:

end frame members each supporting and coupled with one of said end walls;

center frame members each supporting and coupled with one of said dividing walls; and side frame members each extending between and coupled with one of said end frame members and one of said center frame members.

17. A hopper car gate for discharging cargo from a hopper car having a length greater than its width, said car comprising a hopper having an opening and a rim surrounding said opening, said gate comprising:

opposed generally upright side walls;

opposed generally upright end walls coupled with said side walls, wherein said coupled side and end walls present a top opening, a bottom opening comprising first and second sections, and an upper surface surrounding said top opening, wherein said upper surface is adapted to be joined to the rim of the car;

first and second rails extending between and coupled with said side walls adjacent said bottom opening;

a first door supported on said first rail and moveable in a direction that is perpendicular to the length of the car between a closed position which blocks said first section of said bottom opening and an open position which allows the cargo to exit through said first section of said bottom opening;

a second door supported on said second rail and moveable in a direction that is perpendicular to the length of the car between a closed position which blocks said second section of said bottom opening and an open position which allows the cargo to exit through said second section of said bottom opening;

first and second dividing walls extending between and coupled with said side walls, wherein each of said dividing walls is positioned between said first and second doors; and a mating surface extending from each of said dividing walls.

18. The gate of claim 17, further comprising:

end frame members each supporting and coupled with one of said end walls;

center frame members each supporting and coupled with one of said dividing walls; and side frame members each extending between and coupled with one of said end frame members and one of said center frame members.

19. A hopper car gate for discharging cargo from a hopper car having a length greater than its width, said car comprising a hopper having an opening and a rim surrounding said opening, said gate comprising:

opposed generally upright side walls;

opposed generally upright end walls coupled with said side walls, wherein said coupled side and end walls present a top opening, a bottom opening comprising first, second, third and fourth sections, and an upper surface surrounding said top opening, wherein said upper surface is adapted to be joined to the rim of the car;

first and second rails extending between and coupled with said side walls adjacent said bottom opening;

first and second doors supported on said first rail each moveable in a direction that is perpendicular to the length of the car, wherein said first and second doors are moveable in opposite directions between a closed position which blocks said first and second sections, respectively, of said bottom opening and an open position which allows the cargo to exit through said first and second sections, respectively, of said bottom opening; and third and fourth doors supported on said second rail each moveable in a direction that is perpendicular to the length of the car, wherein said third and fourth doors are moveable in opposite directions between a closed position which blocks said third and fourth sections, respectively, of said bottom opening and an open position which allows the cargo to exit through said third and fourth sections, respectively, of said bottom opening.

20. The gate of claim 19, further comprising:

first, second, third and fourth gear racks mounted respectively on said first, second, third and fourth doors, each of said racks extending in a direction parallel to the direction of movement of said doors;

a first drive shaft extending in a direction parallel to the direction of movement of said doors, said first drive shaft positioned between said first door and said third door;

second and third drive shafts each coupled with and extending perpendicular to said first drive shaft;

a first gear mounted on said second drive shaft and engageable with said first gear rack;

a second gear mounted on said third drive shaft and engageable with said second gear rack;

a third gear mounted on said second drive shaft and engageable with said third gear rack; and a fourth gear mounted on said third drive shaft and engageable with said fourth gear rack.

21. The gate of claim 20, further comprising:

a first right angle gear box coupling said first and second drive shafts; and a second right angle gear box coupling said first and third drive shafts.

22. The gate of claim 19, further comprising:

first and second dividing walls extending between and coupled with said side walls, wherein each of said dividing walls is positioned between said first and third doors, and each of said dividing walls is also positioned between said second and fourth doors; and third and fourth dividing walls extending between and coupled with said end walls, wherein each of said third and fourth dividing walls is positioned between said first and second doors, and each of said third and fourth dividing walls is positioned between said third and fourth doors.

23. The gate of claim 22, further comprising:

end frame members each supporting and coupled with one of said end walls;

center frame members each supporting and coupled with one of said first and second dividing walls; and side frame members each extending between and coupled with one of said end frame members and one of said center frame members.

* * * * *